US010746515B1

(12) United States Patent
Parker

(10) Patent No.: US 10,746,515 B1
(45) Date of Patent: Aug. 18, 2020

(54) TRACKED SYNTHETIC ORDNANCE

(71) Applicant: Insights International Holdings, LLC, Franklin, VA (US)

(72) Inventor: Evan Parker, Newsoms, VA (US)

(73) Assignee: INSIGHTS INTERNATIONAL HOLDINGS, LLC, Virginia, CA (US)

( * ) Notice: Subject to any disclaimer, the term of this patent is extended or adjusted under 35 U.S.C. 154(b) by 0 days.

(21) Appl. No.: 16/439,413

(22) Filed: Jun. 12, 2019

(51) Int. Cl.

| | |
|---|---|
| ***F42B 12/38*** | (2006.01) |
| ***F42B 12/36*** | (2006.01) |
| ***H02J 7/00*** | (2006.01) |
| ***F42B 30/08*** | (2006.01) |

(52) U.S. Cl.
CPC ..... *F42B 12/38* (2013.01); *F42B 12/365* (2013.01); *F42B 30/08* (2013.01); *H02J 7/0063* (2013.01); *H02J 2007/0067* (2013.01)

(58) Field of Classification Search
CPC ..... F42B 12/365; F42B 30/08; F42B 12/38; F42B 12/382; F42B 12/385; H02J 7/0063; H02J 2007/0067; H02J 2007/0063
USPC ..... 102/498, 529, 444, 439, 473
See application file for complete search history.

(56) References Cited

U.S. PATENT DOCUMENTS

| | | | | |
|---|---|---|---|---|
| 3,395,640 | A * | 8/1968 | Taylor | F42C 3/00 102/419 |
| 3,754,996 | A * | 8/1973 | Snyder | H01M 6/38 429/114 |
| 5,381,445 | A * | 1/1995 | Hershey | F42B 12/36 102/211 |
| 5,705,766 | A * | 1/1998 | Farace | F42C 9/16 102/202 |
| 6,650,283 | B2 | 11/2003 | Brydges | |
| 8,007,934 | B2 | 8/2011 | Glatthaar et al. | |
| 2001/0013766 | A1* | 8/2001 | Kroll | H01M 6/5033 320/104 |
| 2004/0099173 | A1* | 5/2004 | Rector | F42B 12/382 102/501 |
| 2014/0311369 | A1* | 10/2014 | Rastegar | H01H 35/142 102/216 |
| 2015/0007741 | A1* | 1/2015 | Nath | F42B 12/36 102/430 |
| 2015/0331008 | A1* | 11/2015 | Rastegar | B01J 31/2265 102/216 |

* cited by examiner

*Primary Examiner* — John Cooper
(74) *Attorney, Agent, or Firm* — Fish IP Law, LLP

(57) ABSTRACT

An electronically tracked ordnance having a positioning component, a power supply, and a transmitter. The power supply includes a deformable electrolyte component such that both an anode and a cathode are contacted by the deformable electrolyte component when subjected to acceleration upon firing of the ordnance from a firearm or from deceleration from striking a target. This closes the electrical circuit, thus powering the positioning component and transmitter for transmitting the position of the ordnance.

9 Claims, 14 Drawing Sheets

TRACKED SYNTHETIC ORDNANCE

FIELD OF THE INVENTION

The field of the invention is tracking ordnance.

BACKGROUND

The background description includes information that may be useful in understanding the present invention. It is not an admission that any of the information provided herein is prior art or relevant to the presently claimed invention, or that any publication specifically or implicitly referenced is prior art.

In many situations, there is a need for a shooter to be able to track the movement of a successfully-impacted target. For a hunter, it may be necessary to track an animal after it has been shot from a safe distance until it stops moving and is retrievable. In military environments, tracking the movements of an impacted enemy vehicle or wounded enemy combatant can lead to the discovery of the locations of hidden enemy installations.

The need to track the location of ordnance after firing and impact has led to the integration of location-tracking systems (e.g., GPS transmitters, etc.) into ordnance. The ordnance must also include a power source, such as a battery, for the location-tracking system to work.

Ordnance can often be stored for long periods of time before being used and, as such, systems that used a battery already electrically coupled with the location-tracking hardware suffered from battery draw occurring during storage. Even if the location-tracking hardware is not active while the ordnance is in storage, the electrical connection with the battery will cause a slow, steady draw of battery power.

Others have tried to overcome this problem by delaying the closing of the circuit between the battery and location-tracking hardware until the deployment of the ordnance. However, the existing solutions have required complicated mechanisms to work. The complexities of these existing systems carry an increased risk of failure. Additionally, the complexity of the internal components of existing tracking ordnance systems is difficult to scale down to smaller types of ammunition such as bullets.

U.S. Pat. No. 8,007,934 to Glaathar discusses a mortar where an ampoule is filled with an electrolyte that, when the ampoule is punctured, the electrolyte is released to contact battery cells to generate electrical voltage. However, the use of a liquid electrolyte requires a complicated mechanism for the storage and proper release into contact with the battery cells to generate the electrical power. Additionally, because the electrolyte is a liquid, there is a risk of malfunction due to a premature puncturing of the ampoule or an internal or external leak of the electrolyte during the firing of the mortar or the impact of the mortar.

U.S. Pat. No. 3,754,996 to Snyder also uses a liquid electrolyte that is caused by the centrifugal force of the spinning shell to flow into spaces to complete the electrical circuit. Snyder is silent as to the components of the shell requiring a power supply. However, the system of Snyder would only work to power the shell during flight as upon impact, the rotation holding the liquid electrolyte in place would cease, allowing the electrolyte to flow out of the spaces and thus disrupting the electrical circuit.

U.S. Pat. No. 5,381,445 to Hershey discusses a cartridge where the battery is held apart from an electrical contact by a spacer that, when the cartridge is fired, is crushed by the battery such that the battery comes into contact with the electrical contact to complete the circuit. However, the system in Hershey requires a biasing spring to hold the battery against the contact after firing. This means that, upon impact, the deceleration could cause the spring to compress and thus the battery to become disconnected from the electrical contact. Additionally, if the spring is damaged in any way during impact, the system would fail.

Other systems, such as the one in U.S. Pat. No. 6,650,283 to Bridges discuss triggering mechanisms such as switches that turn on the electronic components. However, in these systems, the circuit is already completed and as such, the battery is slowly drained even during storage.

Other existing systems have required an external modification to the ordnance for the tracking ordnance to function. These external modifications to the ordnance can negatively influence the flight characteristics such that they behave differently from and inferior to ordinary ordnance.

Still other existing tracking systems have required a modification to the weapon firing the tracking ordnance for the system to properly function. Thus, the tracking ordnance is no longer usable in ordinary weapons. These modifications can affect the normal function of the weapon, require additional training to personnel, and are expensive to implement in the numbers typically required by a military unit or organization.

Thus, there is still a need for improved tracking ordnance that reduces the complexity of the power supply components such that it can be easily scaled down to small-caliber bullets, increases the reliability of the tracking system, and can be used along with ordinary ordnance without requiring modifications to the weapons.

SUMMARY OF THE INVENTION

The inventive subject matter provides apparatus, systems and methods in which a tracking bullet includes a battery component having isolated anode and cathode components and includes a deformable solid electrolyte component that, when the bullet is fired, is deformed by the acceleration to complete the electrical circuit by coming into contact with both of the anode and cathode components.

In preferred embodiments, the tracking ordnance comprises a body which includes a positioning component, a transmitter, and a power supply. The positioning component is configured to determine position data representative of the position of the ordnance, including, for example, the global position coordinates of the ordnance. The transmitter is configured to transmit the position data through wireless means to communicate the position of the tracking ordnance to a remote terminal which could be operated by a user. In some embodiments, the transmitter is configured to indicate the location of the tracking ordnance using direction tracking. For example, the transmitter can be a near field communications transmitter configured to transmit the direction of the signal within a limited area. In other embodiments, the transmitter is configured to transmit position data that indicates the coordinates of the tracking ordnance.

In preferred embodiments, the power supply comprises a first terminal and a second terminal, wherein the first terminal and second terminal are an anode and a cathode, respectively. Additionally, it is contemplated the power supply have a deformable solid electrolyte component that substantially deforms upon the firing of the tracking ordnance or, alternatively, upon the striking of a target by the tracking ordnance. Once the deformable solid electrolyte component contacts both terminals, the electrical current produced is directed to the positioning component and the tracking component to determine and transmit the position of the tracking ordnance to an external entity.

Various objects, features, aspects and advantages of the inventive subject matter will become more apparent from the following detailed description of preferred embodiments, along with the accompanying drawing figures in which like numerals represent like components.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

The following description includes information that may be useful in understanding the present invention. It is not an admission that any of the information provided herein is prior art or relevant to the presently claimed invention, or that any publication specifically or implicitly referenced is prior art.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

DETAILED DESCRIPTION

Throughout the following discussion, numerous references will be made regarding servers, services, interfaces, engines, modules, clients, peers, portals, platforms, or other systems formed from computing devices. It should be appreciated that the use of such terms, is deemed to represent one or more computing devices having at least one processor (e.g., ASIC, FPGA, DSP, x86, ARM, ColdFire, GPU, multicore processors, etc.) programmed to execute software instructions stored on a computer readable tangible, non-transitory medium (e.g., hard drive, solid state drive, RAM, flash, ROM, etc.). For example, a server can include one or more computers operating as a web server, database server, or other type of computer server in a manner to fulfill described roles, responsibilities, or functions. One should further appreciate the disclosed computer-based algorithms, processes, methods, or other types of instruction sets can be embodied as a computer program product comprising a non-transitory, tangible computer readable media storing the instructions that cause a processor to execute the disclosed steps. The various servers, systems, databases, or interfaces can exchange data using standardized protocols or algorithms, possibly based on HTTP, HTTPS, AES, public-private key exchanges, web service APIs, known financial transaction protocols, or other electronic information exchanging methods. Data exchanges can be conducted over a packet-switched network, the Internet, LAN, WAN, VPN, or other type of packet switched network.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Figure 1:
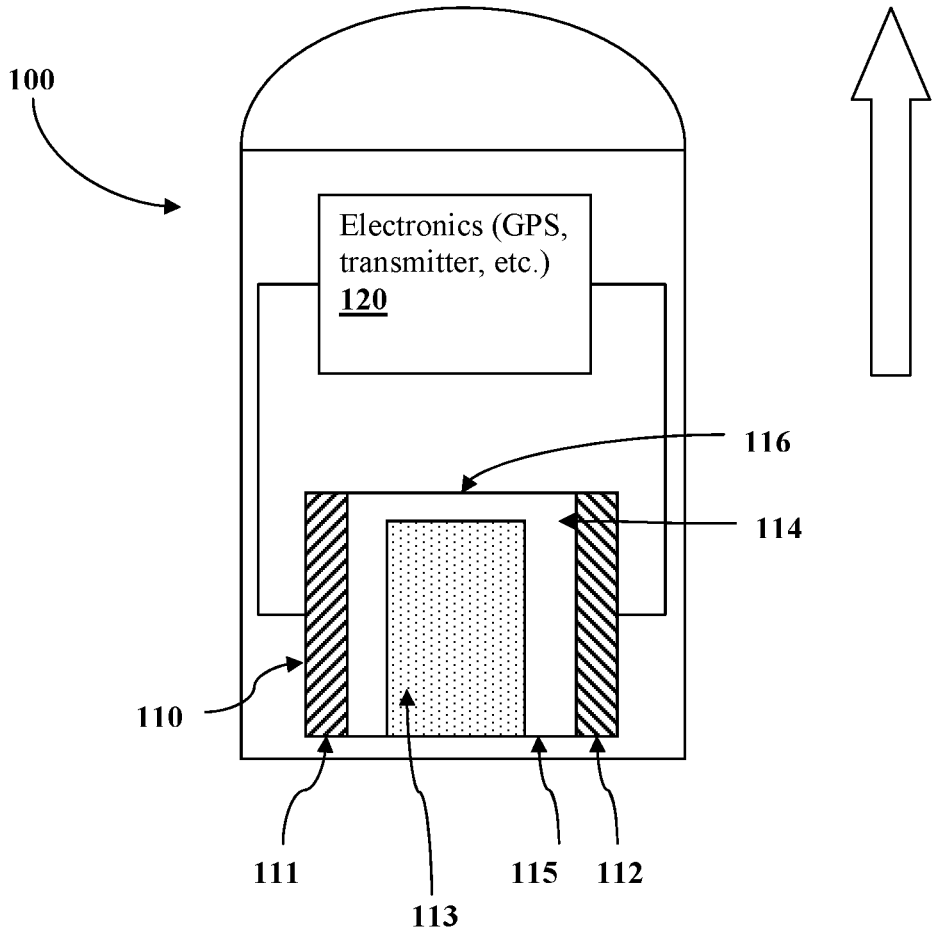
FIG. 1 shows tracking ordnance in a state prior to being fired, according to an embodiment of the inventive subject matter.

FIG. 1 shows one embodiment of tracking ordnance 100 in a state prior to being fired, according to embodiments of the inventive subject matter.

As seen in FIG. 1, tracking ordnance 100 includes a power supply 110 that is electrically coupled to the electronics component 120. The power supply 110 is a battery and, as such, the terms "power supply" and "battery" are used interchangeably herein unless specifically noted.

The state of tracking ordnance 100 seen in FIG. 1 corresponds to the state of ordnance 100 after manufacturing, during handling and storage, during insertion into a magazine or a weapon for firing, or other time prior to being fired by a weapon. In the depicted embodiment, the present invention contemplates that electrolyte component 113 is in contact with the posterior wall/rear surface 115 of a central, interior cavity 114 of battery 110 such that electrolyte component 113 substantially deforms against the rear surface 115 of tracking ordnance 100 upon firing, thereby causing contact with first terminal 111 and second terminal 112.

The battery 110 includes first terminal 111 and second terminal 112 (one of the terminals being an anode component and the other being a cathode component) and electrolyte component 113. In FIG. 1, the first terminal 111 and second terminal 112 are disposed on corresponding side interior surfaces of the battery 110, and are spatially separate from one another such that the two terminals 111,112 are not in contact. Prior to firing, the electrolyte component 113 is disposed within the central cavity 114 of the battery along rear surface 115 and isolated from at least one of the first terminal 111 and second terminal 112 such that the circuit of the battery 110 and the electronics component 120 is not closed.

The electrolyte component 113 is attached to the rear surface 115 (via adhesive, mechanical attachment, or other means) such that the electrolyte component 113 does not separate from the rear surface 115 due to drops, shocks, or other handling of ordnance 100. The attachment of the electrolyte component 113 with the rear surface 115 is of a sufficient strength to keep the electrolyte component 113 from separating from rear surface 115 due to the typical forces experienced by the ordnance 100 if dropped, due to shocks, and other regular handling. However, it is contemplated that, in embodiments, the attachment is not of a sufficient strength to keep the electrolyte component 113 attached to rear surface 115 during a deceleration due to impact (which is a significant magnitude greater than the forces experienced by the ordnance during handling or due to a simple drop).

Figure 2:
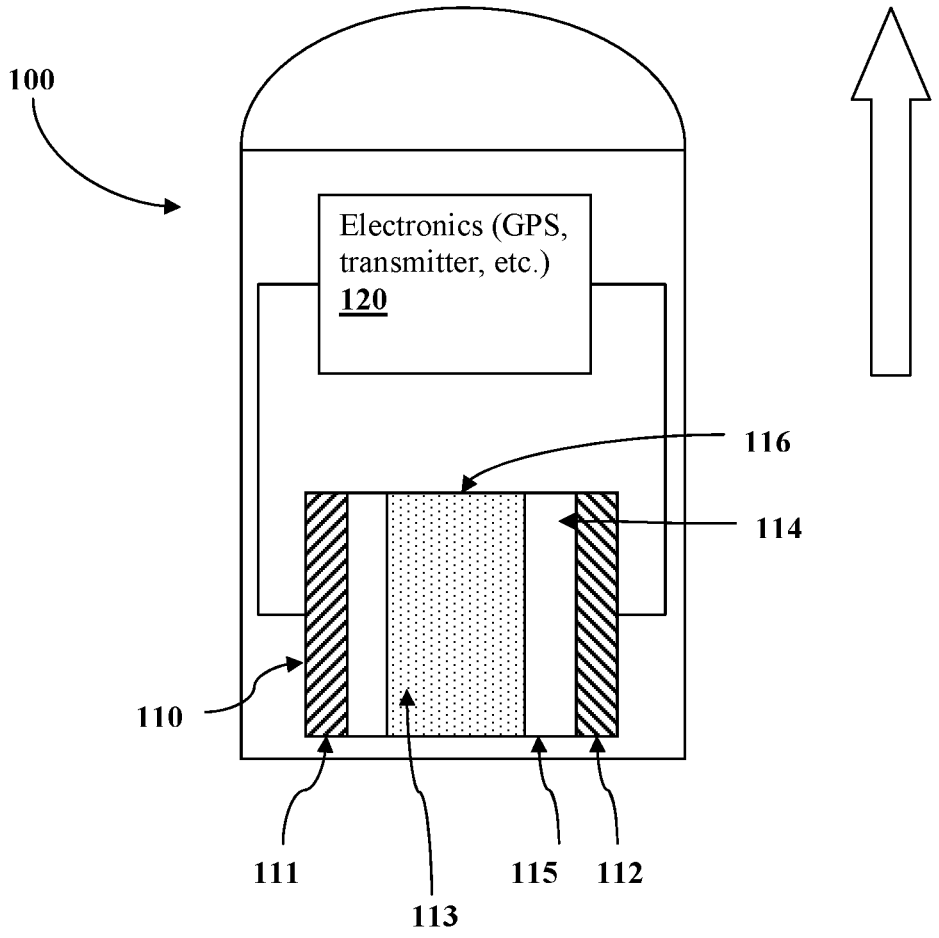
FIG. 2 shows of tracking ordnance having the electrolyte component reaching the front surface of the cavity in a state prior to being fired, according to another embodiment of the inventive subject matter.

In the embodiment of FIG. 1 and others discussed herein, the electrolyte component 113 is illustrated as not coming into contact with the front surface 116. However, it is contemplated that the electrolyte component 113 also contacts the front surface 116, as illustrated in FIG. 2. In these embodiments, the electrolyte component 113 is attached to rear surface 115 as discussed herein but is not attached to front surface 116, such that the electrolyte component 113 will deform and separate from the front surface 116 when undergoing acceleration during firing of the ordnance 100.

In the depicted embodiments, first terminal 111 and second terminal 112 span the entire length between rear surface 115 and the front of central cavity 114. However, alternative embodiments contemplate that first terminal 111 and second terminal 112 do not span the entire length between rear surface 115 and the front of central cavity 114.

The electrolyte component 113 is a deformable solid electrolyte component. A deformable solid electrolyte can comprise any deformable consistency and combination of materials effective to facilitate the flow of current when contacting an anode and a cathode. For example, a deformable solid electrolyte can be a viscoplastic material, a high conductivity semisolid polymer, a slurry, a liquid with high viscosity, an amorphous solid, and/or a Bingham plastic. In some embodiments, electrolyte component 113 can be a high conductivity semisolid polymer with high viscosity, such as, for example, a deformable polymer. In other embodiments, electrolyte component 113 can comprise a viscoplastic material. For example, electrolyte component 113 can be an electrolyte putty exhibiting both viscosity and plasticity. It is contemplated that electrolyte component 113 can comprise a single material, a homogenized mixture of materials, a layering of materials, and/or heterogeneous mixtures. In embodiments where electrolyte component 113 is a mixture of components, electrolyte component 113 can be structured in any way known in the art. For example, electrolyte component 113 can comprise a core of non-Newtonian fluid surrounded by an outer layer of conductive viscoplastic material. However, the inventive concepts described herein are not limited to the aforementioned embodiments and can comprise any combination of materials acting as a deformable medium allowing the flow of electrical charge between a cathode and an anode upon substantial deformation.

The characteristics of the electrolyte component are such that during normal handling, electrolyte component 113 holds its shape and is prevented from establishing contact with both of the first terminal 111 and second terminal 112. The electrolyte component 113 is resistant to changing shape due to forces significantly lower than that experienced during the firing of the ordnance, and as such the electrolyte component 113 will not deform due when subjected to shocks or forces arising from being dropped, thrown, or other types of low-level impact that could be experienced during handling, transport, or storage of the ordnance 100 (collectively, "day-to-day forces"). Thus, the electrolyte component 113 has enough viscosity and/or yield strength (resistance to plastic deformation) to resist substantial deformation when subject to less than a threshold force. The threshold force is higher than the day-to-day forces but lower than the forces that the ordnance 100 experiences during firing of the ordnance 100 (the "firing force"). In embodiments, the threshold force is closer to the firing force than the highest expected day-to-day force. In a variation of these embodiments, the threshold force is within a relatively small percentage (e.g., 30%, 20%, 10%, etc.) of the firing force. In these embodiments, even if the ordnance 100 were to experience forces outside of the typical, anticipated, day-to-day forces, the electrolyte component 113 would nevertheless retain its shape until being fired.

The threshold force required to deform the electrolyte component 113 will vary depending on factors such as the characteristics associated with the ordnance 100 itself (e.g., size, weight, caliber, etc.), the use of the ordnance 100 (i.e., role of the ordnance 100, typical situation of use, transport methods, etc.), the weapon(s) with which the ordnance 100 is used (e.g., caliber, firing velocity, barrel length, etc.), and other factors. For example, ordnance 100 fired from the cannon of a fighter jet will be subjected to different forces than ordnance 100 for a small-caliber pistol. In the case of a fighter jet, ordnance 100 is subject to forces due to movement of the jet itself. Additionally, the two weapon systems are likely to have different exit velocities, accelerations when fired, ordnance size. Thus, the threshold force suitable for the fighter jet example is likely to be different than that for a small-caliber pistol.

As discussed herein, substantial deformation and variants thereof are considered to refer to a deformation of the electrolyte component 113 sufficient to cause the electrolyte component 113 to come into contact with both an anode and a cathode (e.g., the first terminal 111 and second terminal 112) in a battery cell.

As mentioned above, in embodiments, electrolyte component 113 can comprise a viscoplastic material. For example, electrolyte component 113 can advantageously be an electrolyte putty with resilient properties (i.e., rubber-like), which can be particularly advantageous in resisting substantial deformation of electrolyte component 113 until sufficient force is applied such as, for example, upon firing of an ordnance containing electrolyte component 113. The inventive subject matter contemplates the use of combinations of different electrolyte mediums together to achieve desirable properties, such as, for example, synergistic properties. In one example, electrolyte component 113 can comprise a viscoplastic material containing a fluid electrolyte core. In another example, electrolyte component 113 can comprise a substantially homogenized mixture of two different electrolyte mediums. In heterogeneous embodiments, electrolyte component 113 can comprise a one or more solid materials suspended in a non-solid medium. However, the inventive concepts described herein are not limited to the aforementioned embodiments and can comprise any combination of materials acting as a deformable medium allowing the flow of electrical charge between a cathode and an anode. In other embodiments, the electrolyte component 113 can be a high conductivity semisolid polymer with a sufficient viscosity to withstand deformation below the threshold force.

Figure 3:
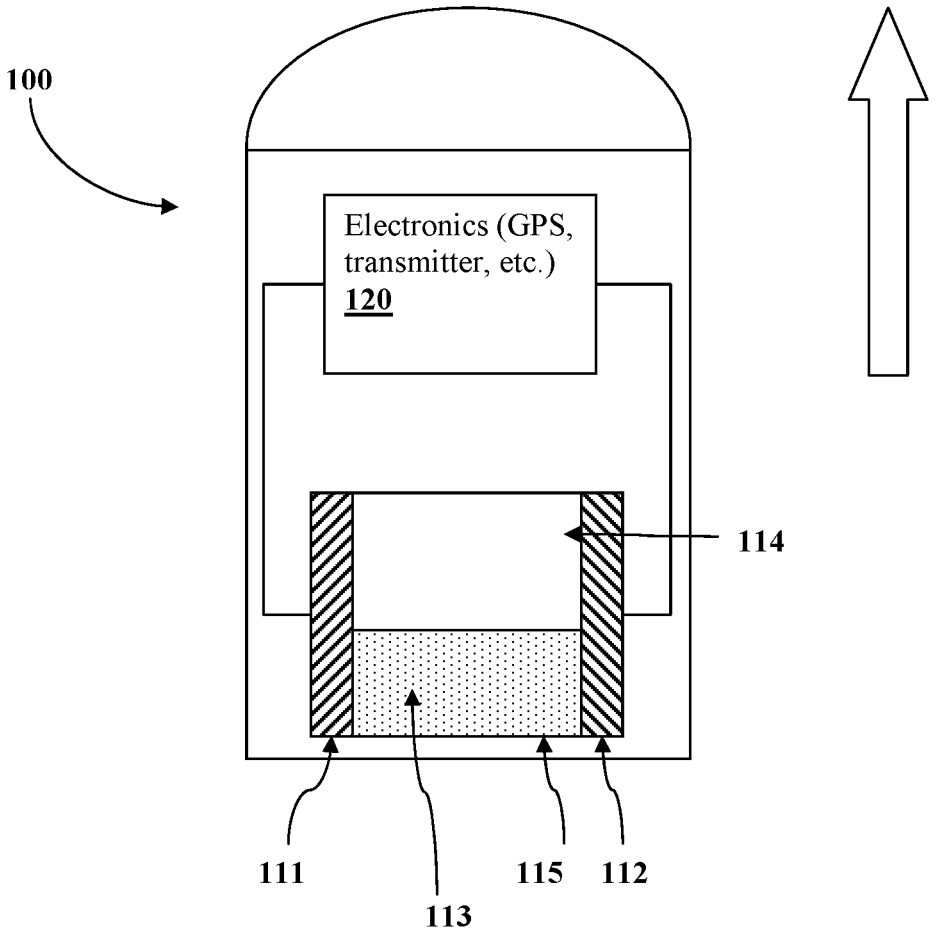
FIG. 3 shows tracking ordnance in a state after being fired, according to embodiments of the inventive subject matter.

When the ordnance 100 is fired by a weapon, the acceleration experienced by the ordnance 100 is sufficient to overcome the resistance of the electrolyte component 113 to substantial deformation (i.e., greater than or equal to the "threshold force"). The force of acceleration causes the electrolyte component 113 to deform and spread against the rear surface 115, causing the electrolyte component 113 to come into contact with both first terminal 111 and second terminal 112, as seen in FIG. 3. This closes the circuit and causes the battery 101 to begin to supply power to electronics component 102.

Figure 4A:
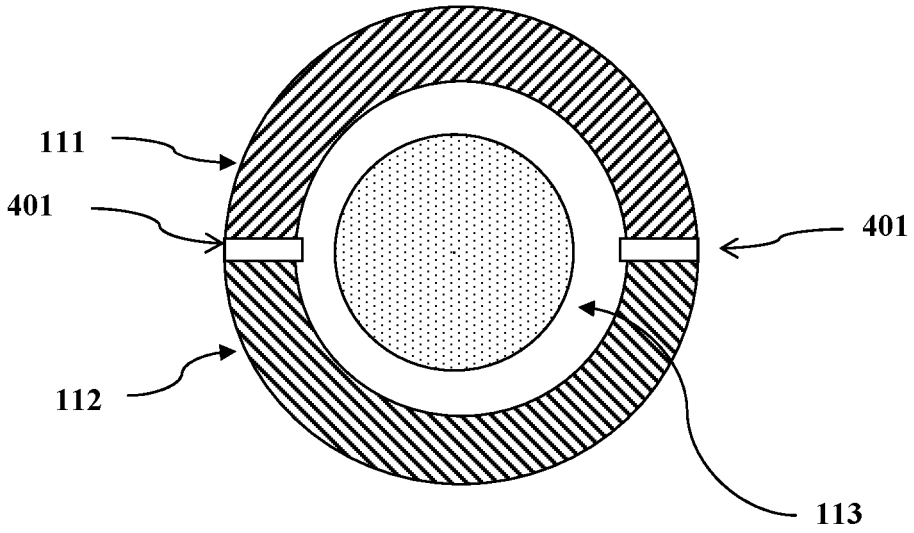
FIG. 4A illustrates a cross-sectional view of the battery of the tracking ordnance prior to being fired, according to an embodiment of the inventive subject matter.

In embodiments, the cross-sectional area of the battery 110 is round, and the battery 110 has a cylindrical shape. An illustrative example of this embodiment is shown in FIG. 4A. As seen in FIG. 4A, each of the first terminal 111 and second terminal 112 is disposed around the perimeter of the cavity 114. The terminals 111,112 are separated by spacers 401, which can be made of electrically insulating material such that terminals 111, 112 are kept separate and from contacting each other.

Figure 4B:
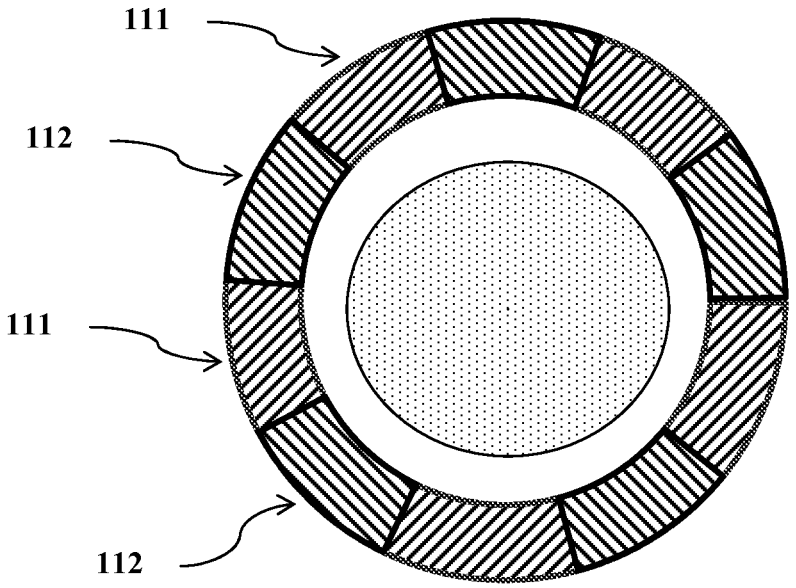
FIG. 4B illustrates a cross-sectional view of the battery of the tracking ordnance prior to being fired, according to another embodiment of the inventive subject matter.

In a variation of the embodiments of FIG. 4A, it is contemplated that each of the first terminal 111 and second terminal 112 are divided into smaller sub-sections that are distributed around the perimeter of the cavity 114. In these embodiments, the arrangement of the sub-sections can be alternating or in some other pattern such that each of the terminals 111, 112 is not located on only one side of the cavity 114. An example of these embodiments is illustrated in FIG. 4B. In the embodiment illustrated in FIG. 4B, spacers 401 are also disposed between each of the alternating sections of terminals 111, 112 but not shown for the purposes of clarity in illustrating the embodiment.

In other embodiments, the cross-sectional shape of battery 110 can be polygonal, (e.g., rectangular, pentagonal, hexagonal, etc.). In these embodiments, the terminals 111, 112 can be disposed on each of the sides of the polygonal cross-sectional shape. They can be arranged in any suitable pattern, and the terminals 111, 112 are separated by spacers or otherwise kept from being in contact within the cavity 114.

It should be noted that the dimensions of the battery 110, including the dimensions of cavity 114, the electrolyte component 113, the spaces between the electrolyte component 113 and one or both of the first terminal 111 and second terminal 112, the dimensions of the first terminal 111 and second terminal 112, the space between front and rear surfaces 116,115 and other aspects of the figures are shown here for the purposes of clarity in illustrating the inventive subject matter. It is contemplated that the space between electrolyte component 113 can be set to particular tolerances effective for particular applications, and can vary depending on factors and/or characteristics associated with the ordnance 100 itself, the use of the ordnance 100, the weapon(s) with which the ordnance 100 is used, and other factors.

Figure 5:
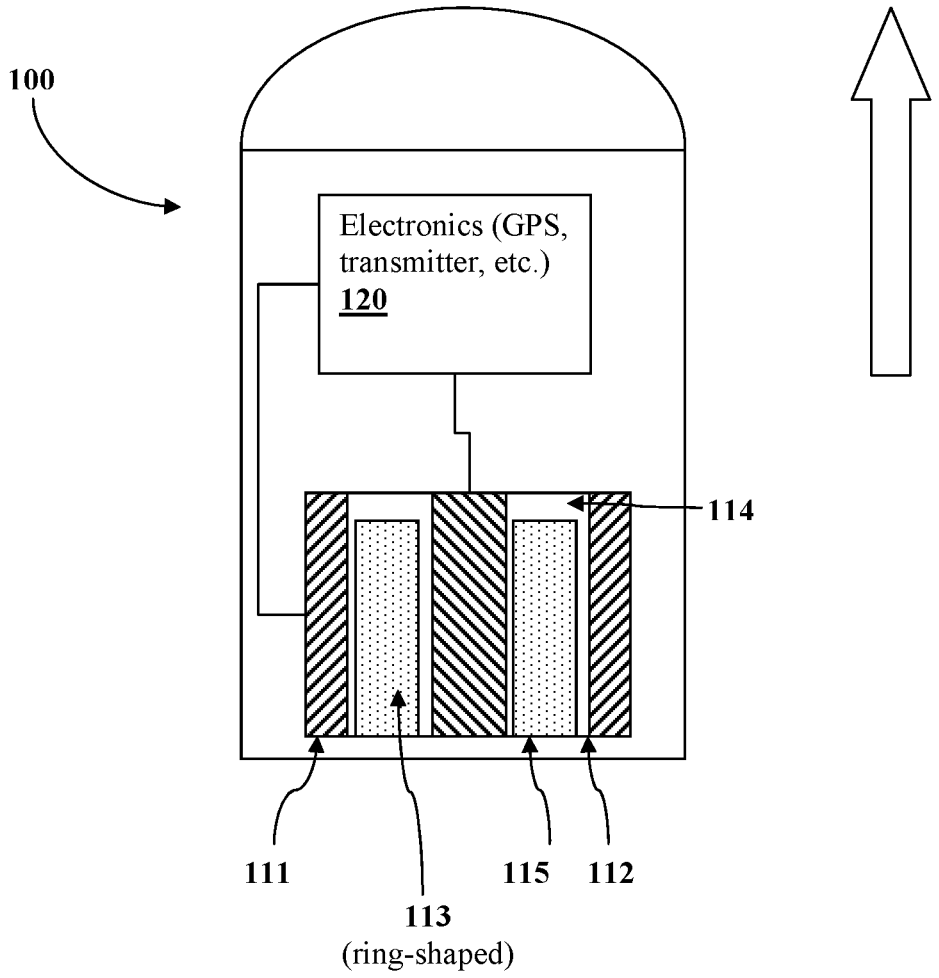
FIG. 5 shows an alternative embodiment of the tracking ordnance in a state prior to being fired.
Figure 6:
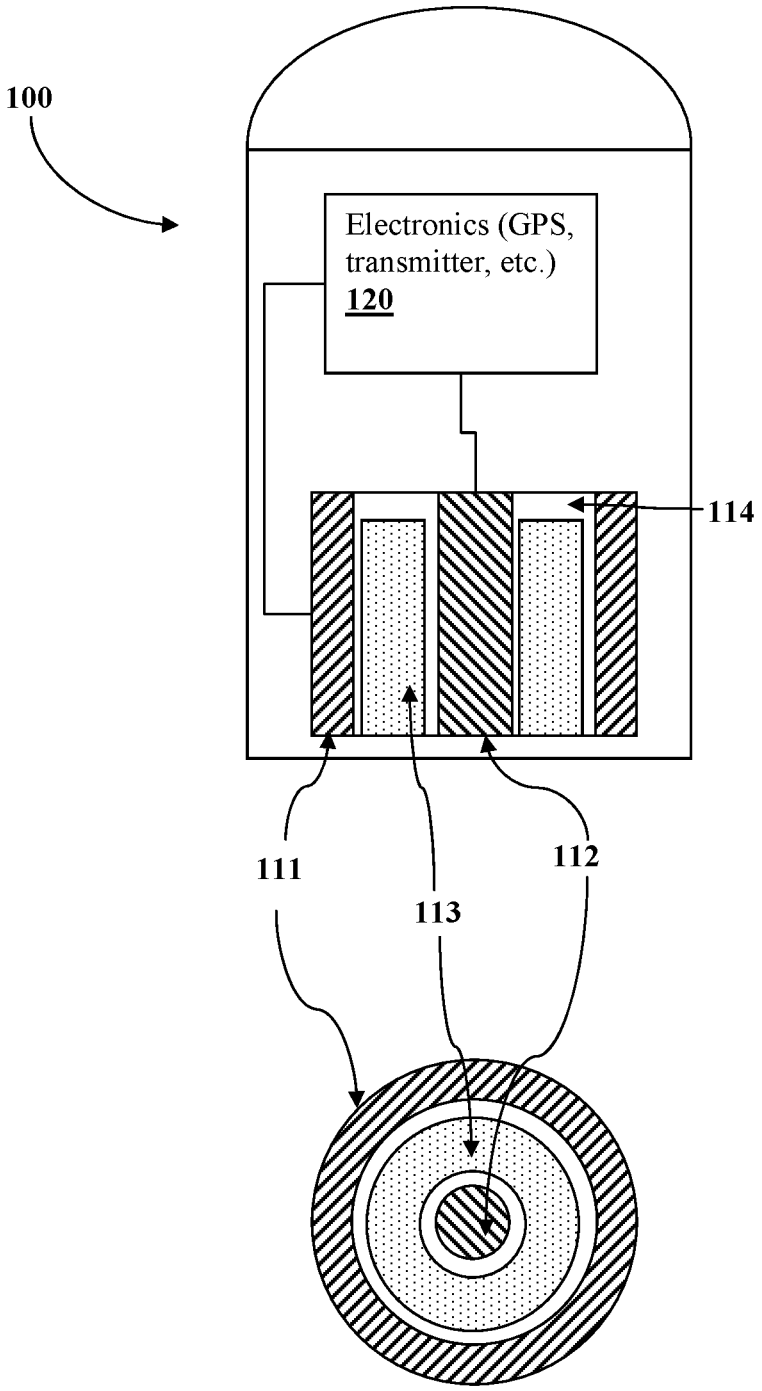
FIG. 6 shows a midsagittal cross-section the embodiment of tracking ordnance of FIG. 5 in the state prior to being fired.

FIG. 5 shows a midsagittal cross-section one embodiment of tracking ordnance 100 in a state prior to being fired, according to the inventive subject matter. In the depicted embodiment, second terminal 112 is contained within first terminal 111 such that the structure comprises two concentric cylinders, wherein the outer cylinder is first terminal 111 and the inner cylinder is second terminal 112. Electrolyte component 113 is disposed between the concentric cylinders in the empty space between first terminal 111 and second terminal 112. It is contemplated that electrolyte component 113 is separated from contacting both first terminal 111 and second terminal 112 in the depicted embodiment. In an alternative embodiment, electrolyte component 113 can be in contact with only the cathode until tracking ordnance 100 is fired. In another alternative embodiment, electrolyte component 113 can be in contact with only the anode until tracking ordnance 100 is fired. FIG. 6 illustrates a top down cross-section of the embodiment of tracking ordnance 100 depicted in FIG. 4 in a state prior to being fired.

Figure 7:
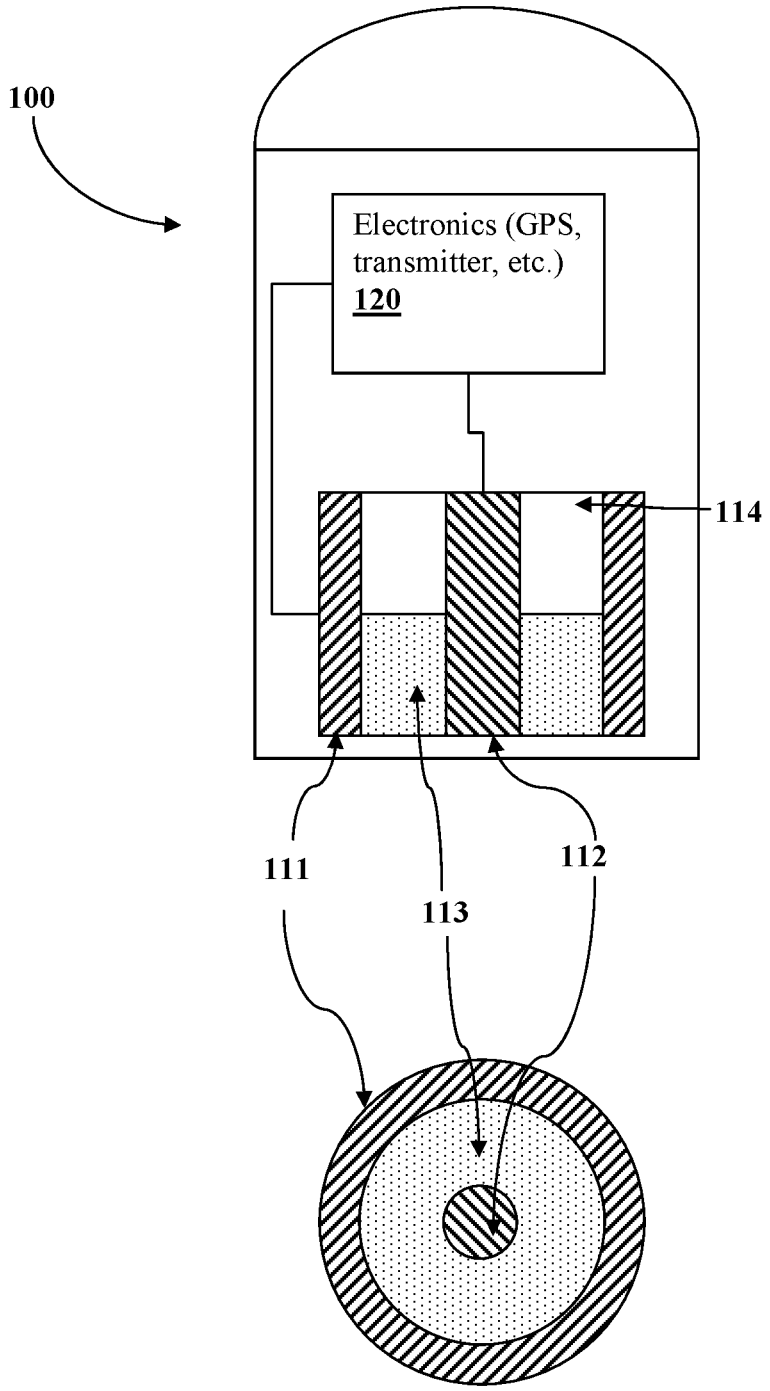
FIG. 7 illustrates the embodiment of tracking ordnance of FIGS. 5-6 in the state after firing.

FIG. 7 illustrates the embodiment of FIGS. 5-6 after being fired. As seen in FIG. 7, the force subjected upon the electrolyte component 113 due to the acceleration of ordnance 100 has caused the electrolyte component 113 to press against the rear surface 115 of cavity 114, deforming such that it has spread to come into contact with the first terminal 111 and second terminal 112.

Figure 8:
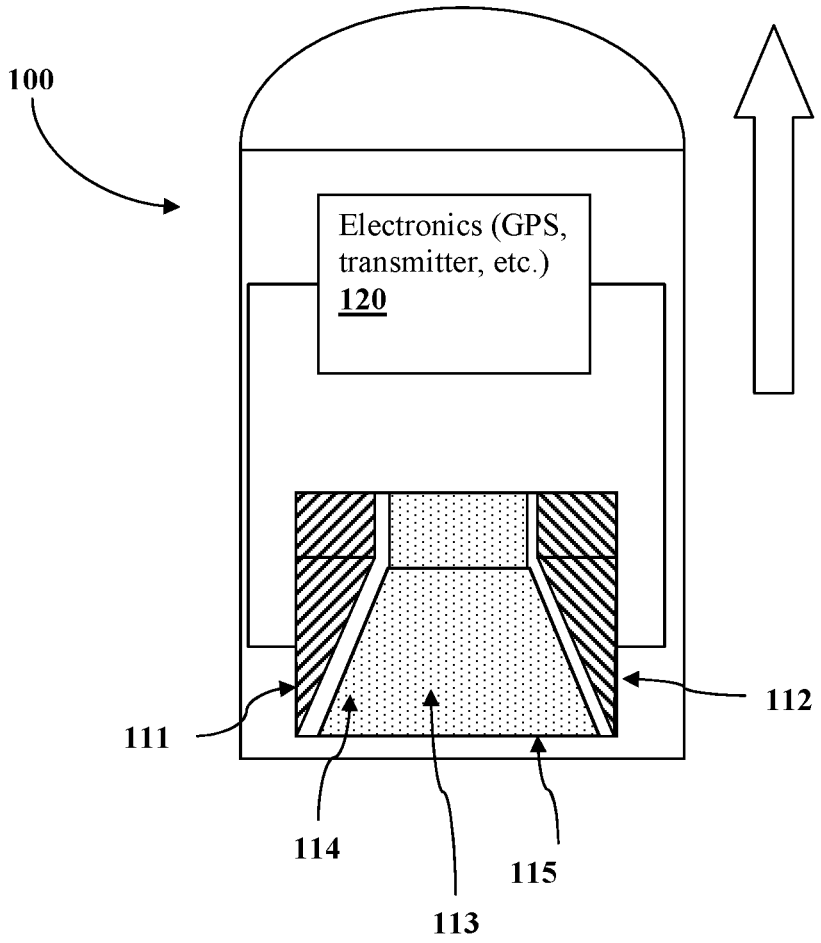
FIG. 8 shows tracking ordnance in a state prior to being fired, according to another embodiment of the inventive subject matter.

In certain instances, such as for certain types of ordnance 100 fired from certain types of weapons and/or in certain situations or uses, the forces experienced by the ordnance 100 during deceleration due to impact can be equal to or even greater than those experienced during the acceleration of the ordnance 100 when the ordnance 100 is fired. In these instances, the electrolyte 113 may deform a second time at impact. To ensure that the electrolyte 113 does not completely separate from at least one of the first terminal 111 or second terminal 112, the sides of cavity 114 with the terminals 111, 112 are angled inward from the rear section of the cavity 114 towards the front section of the cavity 114, as seen in FIG. 8. It should be understood that, in embodiments, any lateral portions of cavity 114 not formed by terminals 111,112 are similarly shaped. As shown in FIG. 8, the electrolyte 113 is shaped to be approximately parallel with the sides of the cavity 114.

As shown in FIG. 8, the cavity 114 includes a section where the sides formed by terminals 111, 112 slope inward. The embodiment of FIG. 8 also includes a front-ward section (terminating in front surface 116) where the sides of cavity 114 are parallel, where the space of cavity 114 has a narrower cross-sectional area.

In embodiments where first terminal 111 and second terminal 112 are concentrically positioned (e.g. FIGS. 5-7), the outermost terminal resembles a hollow conical frustum with the innermost terminal and electrolyte component 113 disposed therein.

By configuring the terminals in a non-parallel arrangement as discussed above, it is contemplated that the present invention can better prevent displacement of electrolyte component 113 and loss of contact with both terminals upon sudden acceleration and/or deceleration.

Figure 9:
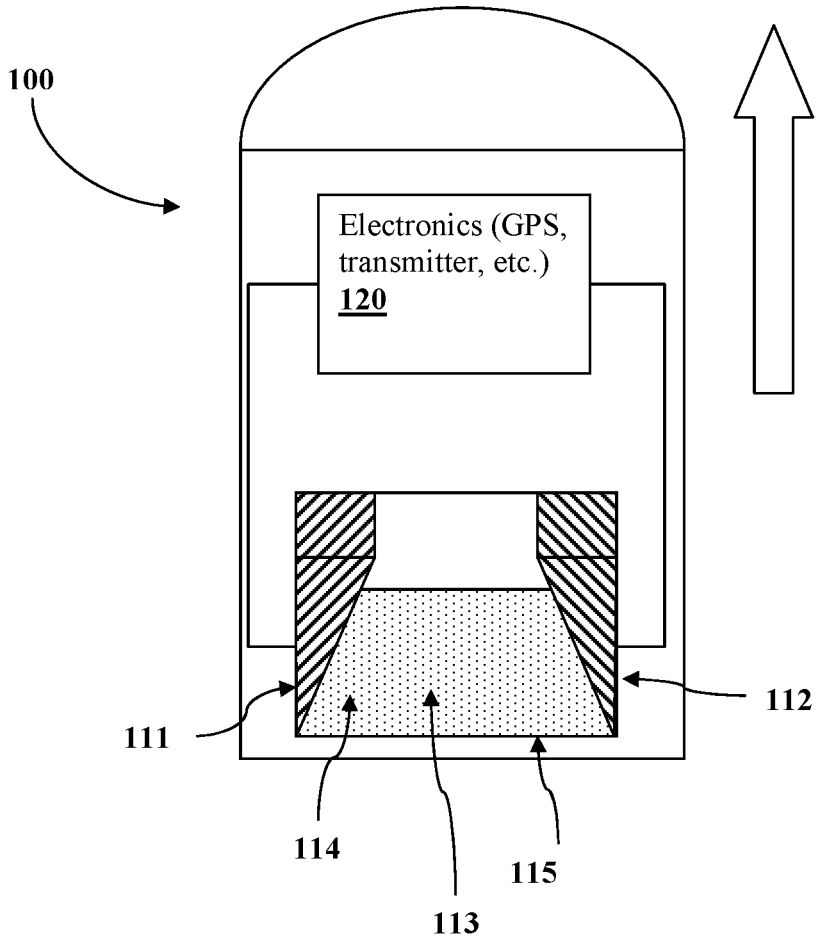
FIG. 9 illustrates the ordnance of FIG. 8 after being fired.

FIG. 9 illustrates embodiment of FIG. 8 with the electrolyte 113 spread after firing, contacting both terminals 111, 112. Because of the sloping sides of cavity 114 and because the shape of the electrolyte 113 prior to firing is largely parallel to the sides of cavity 114 and includes a section extending into the smaller, vertically-sided upper section of the cavity 114, the electrolyte 113 spreads higher within the cavity 114 as there is less volume in the slope-sided portion of the cavity to accommodate the spreading electrolyte material.

Figure 10:
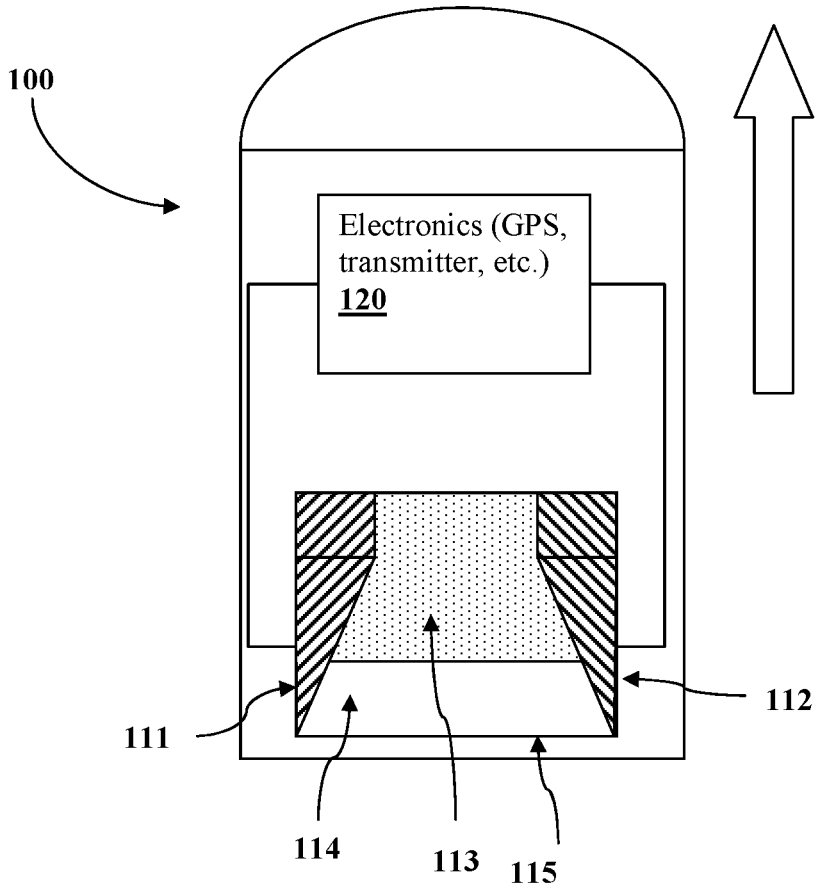
FIG. 10 illustrates the ordnance of FIGS. 8-9, after certain types of deceleration due to impact.

FIG. 10 illustrates the embodiments in FIGS. 8-9 in situations where the deceleration force is sufficient to cause a second deformation of the electrolyte 113. As seen in FIG. 10, the deceleration of ordnance 100 has overcome the threshold force and caused the electrolyte 113 to deform and travel in a forward direction. The shape of internal cavity 114 thus funnels the electrolyte 113 to its final resting position after deceleration, keeping the electrical connection by remaining in contact with both terminals 111, 112. Even if the deceleration force causes the deformation of electrolyte 113 to move forward within cavity 114 in an inconsistent or uneven manner, the narrowing the cross-sectional area with the sloping sides and front-ward section of cavity 114 with a reduced cross-sectional area combined with the amount of the electrolyte material (greater than the volume of the smaller frontward parallel-sided section of the cavity) decreases the likelihood that the electrolyte 113 will become completely separated from one or both of the terminals 111, 112.

Figure 11A:
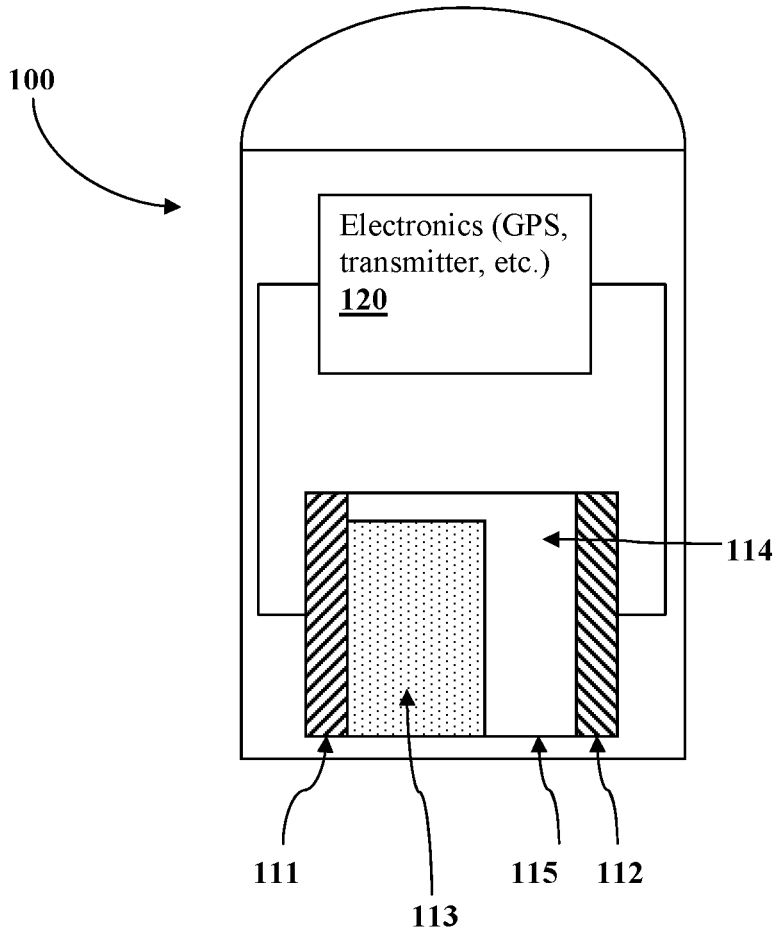
FIGS. 11A and 11B show alternative embodiments of the tracking ordnance of FIG. 1.
Figure 11B:
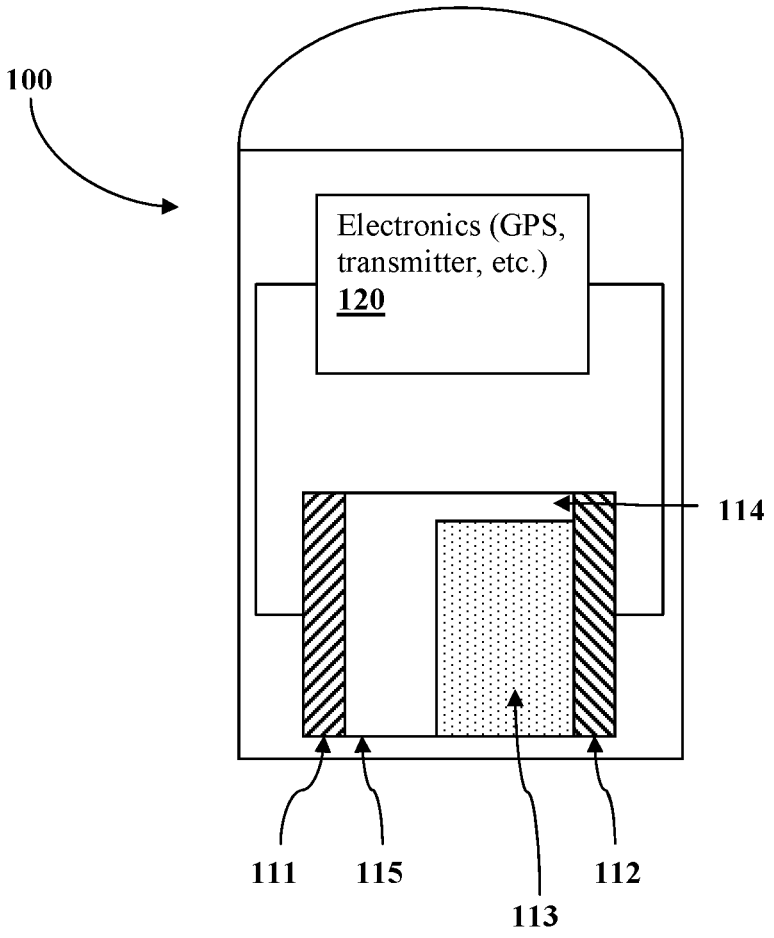

In the embodiment of FIG. 1, the electrolyte component 113 is shown as being isolated from both first terminal 111 and second terminal 112. However, in other embodiments, it is contemplated that the electrolyte component 113 can be disposed within the cavity 114 such that it is contact with one of the first terminal 111 and second terminal 112 while remaining isolated from the other of the terminals. FIGS. 11A and 11B provide illustrative examples of these embodiments.

For certain types of ordnance 100 fired from certain types of weapons, the force experienced by the ordnance 100 due to the deceleration of the ordnance 100 on impact is known to be consistently greater than that of the acceleration of the ordnance 100 when fired. In the alternative embodiment depicted in FIG. 12, electrolyte component 113 is in contact with the front surface 116 (nearest the electronic components) such that rapid deceleration will cause electrolyte component 113 to substantially deform against the front surface 116 of cavity 114, thereby causing contact with first terminal 111 and second terminal 112. FIG. 13 illustrates the embodiment of FIG. 12 after impact, where electrolyte component has deformed and has come into contact with the terminals 111, 112.

In these embodiments, the threshold force required for the deformation of the electrolyte component 113 is greater than the acceleration force typically experienced by the ordnance 100 but less than the deceleration force experienced upon impact. This way, the electrolyte component 113 does not substantially deform during firing.

Figure 12:
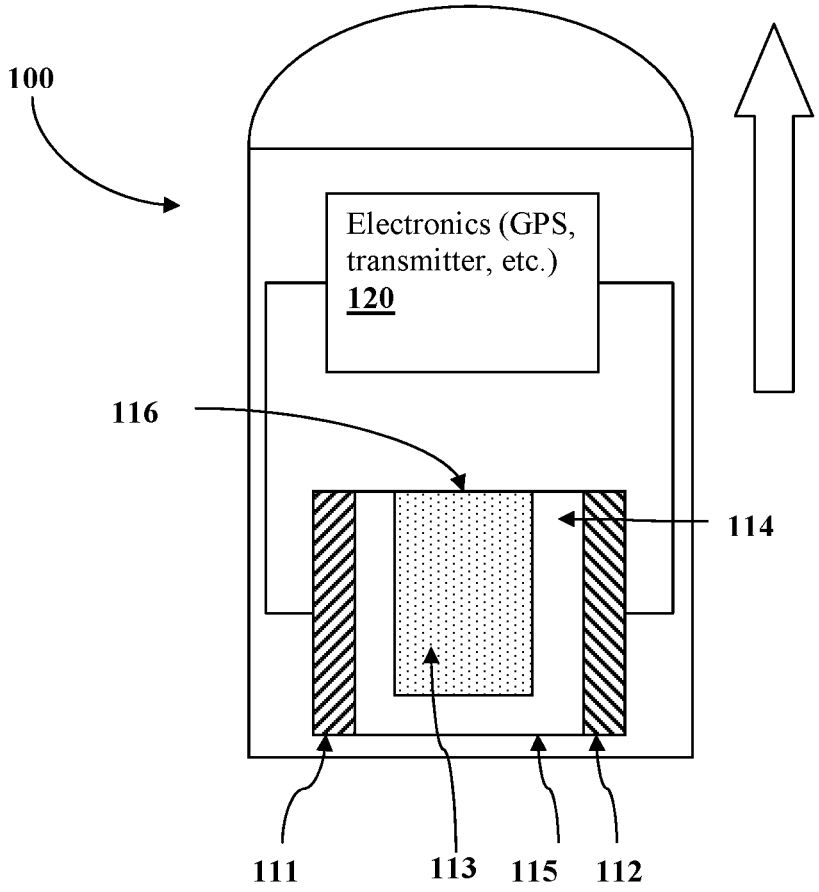
FIG. 12 shows an embodiment where the electrolyte substance is attached to the front surface of the cavity, according to embodiments of the inventive subject matter.
Figure 13:
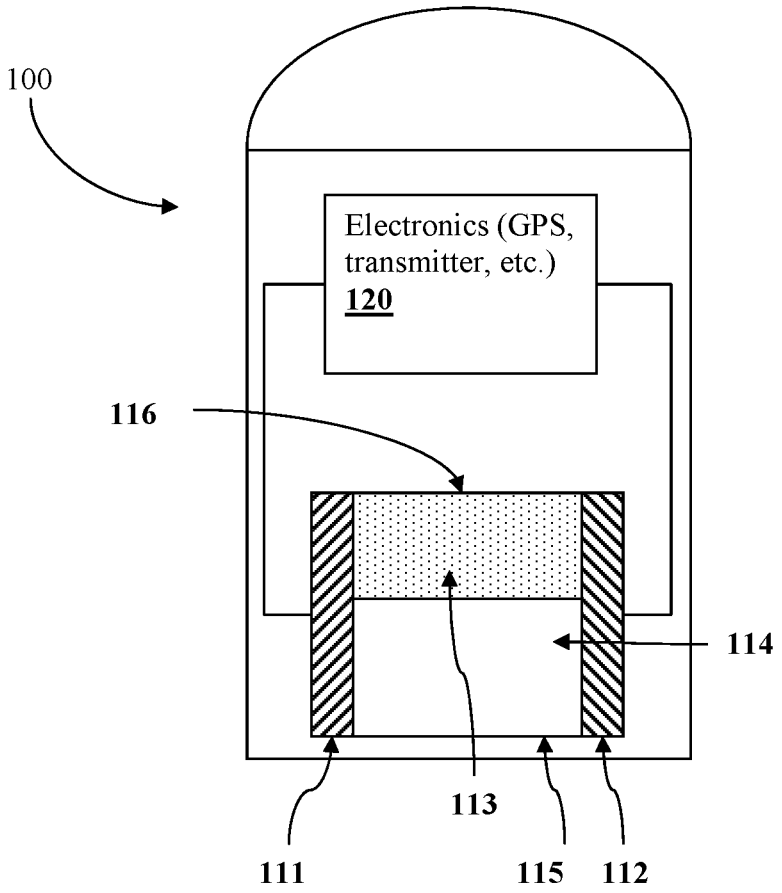
FIG. 13 shows the embodiment of FIG. 12 after deceleration due to impact.

In the embodiments of FIGS. 12-13, the electrolyte component 113 is attached to the front surface 116 (via adhesive, mechanical attachment, or other means) such that the electrolyte component 113 does not separate from the rear surface 116 due to drops, shocks, or other handling of ordnance 100 as well as during acceleration during firing.

It is also contemplated that the variations of the embodiments shown in FIGS. 2-11B are similarly applicable as variations to the embodiments of FIGS. 12-13, except that the electrolyte component 113 is attached to the front surface 116 instead of the rear surface 115. Additionally, the following differences or additional variations apply to certain embodiments:

In the embodiment that is the variation of FIG. 2, the electrolyte component 113 is attached to the front surface 116 and also not to the rear surface 115.

In the embodiment that is the variation of FIG. 8, the same sloping-side configuration is used. Since the electrolyte component 113 will not deform upon firing because the force of acceleration will not overcome the threshold force of the electrolyte component 113, the illustration of FIG. 9 does not apply to this embodiment. However, the deceleration force will cause the deformation of the electrolyte component 113 as seen in FIG. 10.

The electronics component 120 in the illustrative examples discussed herein is considered to include a positioning component (e.g., a GPS receiver or other positioning/tracking hardware) programmed to track the location of the ordnance and a communication device (e.g., wireless transmitter or other wireless communication interface) configured to transmit data to an external receiver. Examples of contemplated tracking devices include GPS receivers, cellular positioning systems, Wifi positioning systems, inertial positioning systems, etc. Thus, in the embodiment shown, the communication device transmits the position data determined by the tracking device to the external receiver. In embodiments where the only function of the ordnance is to provide a location, the communication device can be a one-way communication device (i.e., transmit only). In other embodiments, the communication device can a two-way communication device that is capable of receiving data wirelessly from an external computing device that can be used to control and/or alter the functions of connected components. It is contemplated however that the tracking device is built to withstand the accelerative forces or rapid deceleration of an ordnance within a determined threshold.

In embodiments, the electronics component 120 includes a hardware processor that is communicatively coupled to the positioning component and transmitter. In these embodiments, the processor is programmed to determine whether the ordnance 100 is moving and regulate whether or not the transmitter transmits the position of the ordnance based on whether the ordnance 100 is moving.

In these embodiments, the processor repeatedly receives the position information from the positioning component. If the processor determines from at least two samples of position information that the position of the ordnance 100 has not moved, the processor then causes the transmitter to refrain from transmitting the position information. Depending on the sample rate of the positioning component, the processor can be programmed to require more than two consecutive samples have the same position information before stopping the transmission of the position information.

In a variation of these embodiments, the processor can monitor the samples over a set amount of time and, if the processor determines that the ordnance 100 has not moved in a set amount of time, cause the transmitter to stop transmitting the position information. To do so, the processor is programmed to start a timer with each received sample of position information. The processor then compares the position of the next subsequently received sample of position information. If the position is the same, the timer continues to run. If the position is different, the processor resets the timer. If the timer reaches a threshold time, the processor then causes the transmitter to stop transmitting the position information.

To account for variations in precision of the positioning component, the processor can be programmed to consider samples within a threshold distance of each other to be the same location for the purposes of executing the processes described above.

In embodiments, the processor is further programmed to, upon determining that a subsequent sample of position information indicates that the ordnance 100 has changed position, to cause the transmitter to resume transmitting the position information. Thus, if the transmitter had been previously stopped from transmitting position information, it resumes transmission.

By shutting down the transmitter when the processor has determined that the ordnance 100 has not moved, the system of these embodiments not only conserves battery life but also avoids unnecessarily risking the detection of the ordnance 100 based on radio emissions for transmissions when there is no new information to report.

While the electronics component 120 discussed herein includes a positioning component, it is contemplated that the electronics component 120 could be any component that requires power to perform a function. Thus, electronics component 120 can include devices such as electrical devices, electromechanical devices, powered mechanical devices, hardware-only devices, computing devices (e.g., programmable devices that include a combination of hardware and software), or any other physical device requiring a power supply to perform a function. As such, in embodiments, the electronic component 120 can, in addition to or instead of the positioning device and/or the communication device, include other systems such as navigation systems, flight control systems, sensor packages, cameras, microphones, etc.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A tracking ordnance, comprising:

a body comprising:

an electronics component; and a power supply electrically coupled to the electronics component, the power supply comprising:

a central cavity having a rear surface, at least one side surface and a front surface; a first terminal component disposed within the central cavity, wherein the first terminal is an anode;

a second terminal component disposed within the central cavity, the second terminal component separated from the first terminal component and wherein the second terminal is a cathode; and a deformable electrolyte component disposed within the central cavity along the rear surface and between the anode component and the cathode component, such that the electrolyte component is not in contact with at least one of the anode component and cathode component;

wherein, when subjected to acceleration during firing of the ordnance, the electrolyte component deforms against the rear surface and comes into contact with both the first terminal component and the second terminal component;

wherein:

a first of the cathode and the anode comprises a cylinder extending into the central cavity from the rear surface;

a second of the cathode and the anode comprises a ring surrounding the cylinder; and the deformable solid electrolyte component has a ringed cross-sectional shape and is disposed within the central cavity such that the electrolyte component surrounds the cylinder and is surrounded by the ring.

2. The tracking ordnance of claim 1, wherein the electrolyte component is shaped to extend from the rear surface towards the front surface within the central cavity.

3. The tracking ordnance of claim 1, wherein each of the first and second terminal components are disposed along the at least one side surface of the central cavity.

4. The tracking ordnance of claim 3, wherein the at least one side surface of the central cavity tapers inward from the rear surface towards the front surface such that the cross-sectional area of the central cavity decreases as the at least one side surface tapers inward.

5. The tracking ordnance of claim 3, wherein:

each of the first and second terminal components comprise a plurality of first and second terminal components, respectively; and the plurality of first and second terminal components are distributed along the at least one side surface in an alternating pattern.

6. The tracking ordnance of claim 1, wherein the electronics component comprises:

a positioning component configured to, when activated, determine position data representative of the position of the tracking ordnance; and a transmitter communicatively coupled with the positioning component, and programmed to, when activated, transmit the position of the tracking ordnance.

7. The tracking ordnance of claim 6, further comprising a processor communicatively coupled to the positioning component and the transmitter, the processor programmed to:

repeatedly receive the position data of the tracking ordnance from the positioning component;

determine, from at least two received position data, that the tracking ordnance has not moved; and in response to determining that the tracking ordnance has not moved, cause the transmitter to stop transmitting the position data of the tracking ordnance.

8. The tracking ordnance of claim 7, wherein the processor is programmed to:

determine, from at least two received position data, that the tracking ordnance has moved; and in response to determining that the tracking ordnance has moved, cause the transmitter to transmit the position data of the tracking ordnance.

9. The tracking ordnance of claim 1, wherein the electrolyte component requires a force meeting or exceeding a threshold force to deform.

* * * * *